US008235204B2

(12) United States Patent
Loughman et al.

(10) Patent No.: US 8,235,204 B2
(45) Date of Patent: Aug. 7, 2012

(54) LOCKABLE PACKAGE WITH SLIDE TRAY

(75) Inventors: Robert Loughman, Elmira, NY (US); John Turner, Elmira, NY (US); George Howell, Elmira, NY (US)

(73) Assignee: Howell Packaging, division of F.M. Howell & Company, Elmira, NY (US)

( * ) Notice: Subject to any disclaimer, the term of this patent is extended or adjusted under 35 U.S.C. 154(b) by 184 days.

(21) Appl. No.: 12/630,598

(22) Filed: Dec. 3, 2009

(65) Prior Publication Data

US 2011/0132779 A1 Jun. 9, 2011

(51) Int. Cl.
*A45C 13/10* (2006.01)

(52) U.S. Cl. ..... 206/1.5; 206/267; 206/313

(58) Field of Classification Search ..... 206/1.5, 206/19, 242, 320, 521; 229/19
See application file for complete search history.

(56) References Cited

U.S. PATENT DOCUMENTS

| | | | | |
|---|---|---|---|---|
| 1,253,489 | A | 1/1918 | Houghland | |
| 3,005,546 | A | 10/1961 | Sanford | |
| 3,334,734 | A | 8/1967 | Meyers | |
| 3,651,928 | A | 3/1972 | Weisman | |
| 3,670,881 | A | 6/1972 | Dutcher | |
| 3,761,010 | A * | 9/1973 | Rosenburg, Jr. | 229/125.125 |
| 3,949,868 | A * | 4/1976 | Allen | 206/777 |
| 4,081,126 | A * | 3/1978 | Barnard | 206/256 |
| 4,319,680 | A | 3/1982 | Hiemstra | |
| 4,895,296 | A | 1/1990 | Trauschke | |
| 5,244,093 | A | 9/1993 | Carmichael et al. | |
| 5,277,304 | A * | 1/1994 | Brizzi et al. | 206/256 |
| 5,379,890 | A * | 1/1995 | Mahler | 206/310 |
| 6,230,917 | B1 | 5/2001 | Whitnell | |
| 6,230,966 | B1 | 5/2001 | Beales et al. | |
| D575,452 | S * | 8/2008 | Jones et al. | D27/189 |
| 7,469,786 | B1 * | 12/2008 | Rowley et al. | 206/521 |
| 7,617,930 | B2 * | 11/2009 | Jones et al. | 206/256 |
| 2007/0181458 | A1 * | 8/2007 | Ehrlund | 206/528 |

* cited by examiner

*Primary Examiner* — J. Gregory Pickett
*Assistant Examiner* — Raven Collins
(74) *Attorney, Agent, or Firm* — Arent Fox LLP

(57) ABSTRACT

A lockable package includes an outer sleeve defined by connected first and second panels, the sleeve having at least one open end. An inner container is slidable within the sleeve, and having a first portion joined to a second portion, wherein at least one of a height and a width of the first portion is less than a corresponding height and width of the second portion. A difference between one of the height and the width of the first portion and the corresponding height and width of the second portion defines a ridge. A locking assembly is provided at the at least one open end of the sleeve and is configured to releasably engage the ridge, wherein the inner container is removable through the open end of the sleeve by disengaging the locking assembly from the ridge.

14 Claims, 10 Drawing Sheets

LOCKABLE PACKAGE WITH SLIDE TRAY

BACKGROUND OF THE INVENTION

1. Field of the Invention

This invention relates to a unique package having two components, a first component is an outer shell or sleeve with foldable flaps, and a second component is a tray configured with ridges designed to lockingly engage free ends of the sleeve flaps, thereby locking the package in a closed state and preventing the tray from easily being removed from the outer sleeve.

2. Description of Related Art

It is common practice for industrial parts manufacturers, medical device, pharmaceutical, food industry, and other such companies to use various containers or packages to package articles, products and food stuff intended to be sold or delivered to consumers. Typically, such packages are of a simple and relatively inexpensive construction, but which include an obstacle to opening the package that deters or prevents theft. Attempts have been made to provide a package that contains sufficient impediments to deter theft of the contents without rendering the articles or products contained therein inaccessible. However, the mechanism serving as the obstacle to opening the package typically has a complicated design, which has increased the expense of production without providing a corresponding improvement in deterring theft.

For example, U.S. Pat. No. 3,761,010 to Rosenburg, Jr. (hereinafter Rosenburg) discloses a safety carton having a tray 10 that slides into a sleeve 20. A bottom wall panel 26 of the sleeve has an opening 30 defined between abutment pieces 32, 33. When assembled, the sleeve 20 has a first, larger aperture 31 defined therein overlapping a second, smaller aperture 30 defined therein. As shown in FIG. 4 of Rosenburg, a lower surface of the tray 10 is received within the first aperture 31 defined in the sleeve 20 such that the edges of the tray 10 are engaged by the edges of the abutment pieces 32, 33 and prevent the tray 10 from being withdrawn from the sleeve 20.

As shown in FIG. 5 of Rosenburg, to disengage or unlock the tray 10 from the abutment edges 32, 33 of the sleeve 20, a consumer bends one of the abutment pieces 32 or 33 as well as overlapping panel 22 downward while pushing the tray 10 upward through the openings 30, 31. The edge of the tray 10 is disengaged from the edge of the piece 32 or 33, thereby permitting the tray 10 be slidingly removed from the sleeve 20. The locking mechanism for the Rosenburg carton is limited to a single side, or bottom, and is therefore susceptible to being compromised by small children without much effort.

In another example, U.S. Pat. No. 5,244,093 to Carmichael et al. (hereinafter Carmichael) disclose a package 10 having a sleeve 14 defined by open top and bottom ends. As shown in FIG. 6 of Carmichael, retaining flaps 24 abut or engage a lid 30 of a lowermost package 12c at an underneath position. An edge of the flaps 24 engages a downwardly facing edge 37 of the lid flange 30 and the corner 38 of the package 12c wall 32. As such, the edges of the flaps 24 engaging the flange 36 prevent the lowermost package 12c from falling out of the open bottom end of the sleeve 14. While the flaps 24 prevent the package 12c from being removed from the bottom of the package 10, a simple retainer 26 formed by overlapping flaps 46a, 46b defines a closed upper end 22. Simply pushing packages 12a-12c upward would appear to rupture the retainer 26 and provide access thereto.

In yet another example, U.S. Pat. No. 5,379,890 to Mahler discloses jacket 10, 10' for holding or storing a compact disc therein that has an interior space 14 in which a tray 60 is inserted. End flaps 34, 38 and 45, 45 are folded into the space 14 along fold lines 36, 40. When the tray 60 is withdrawn from the sleeve 10, 10', the edges 48, 52 of the flaps 34, 38 and 45, 45 engage the rims 68, 74 of the tray 60, providing access to the contents of the tray 60 while preventing the tray 60 from being completely pulled out of the sleeve 10, 10'.

U.S. Pat. No. 4,895,296 to Trauschke discloses a sleeve 10 open at both ends 18 with a window provided in a side wall to provide a view to the products contained in the sleeve 10. Flaring right and left lips 20 and 22 are folded into an interior space of the sleeve 10 to permit packages to be loaded into the sleeve 10. The inner edges of the lips 20, 22 catch on the packages being withdrawn, and act as a latch to prevent the removal of the packages from the sleeve 10. The lips 20, 22 are readily compressed to release the enclosed package therefrom.

In another example, U.S. Pat. No. 3,670,881 to Dutscher discloses a display carton having a plastic tray A that is inserted into a paperboard sleeve B. As shown in FIGS. 1-3 and 5 of Dutscher, the tray A has side walls 11 and end walls 12 with flanges provided at their lowermost edge. Abutments 32 of the side panels 24, 24 engage flared lower ends 13, 13 of the walls 11 and 12 to lock the tray A in the sleeve B.

In a further example, U.S. Pat. No. 3,334,734 to Meyers discloses a package having a cover 2 that has tray engaging side flaps 9 and end flaps 10. The cover 2 has openings 3, 3 defined in an upper surface. A flange 14 of the tray 11 engages the edges of the flaps 9, 10, thereby preventing the tray 11 from being removed from the cover 2.

U.S. Pat. No. 4,319,680 to Hiemstra discloses an open ended sleeve 1 with flaps 6 bent into the interior space of the sleeve 1 from both ends of the sleeve. The edges of the flaps 6 engage flanges 3 of blister packs 4 inserted into the sleeve 1, thereby preventing the blister packs 4 from falling out of the sleeve 1.

SUMMARY OF THE INVENTION

It is an aspect of this invention to provide a package having a slidable tray, clamshell shaped or other closed container that is lockingly engaged by an outer sleeve.

Another aspect of this invention is to provide a unique package that provides an outer sleeve having at least one open end, wherein a locking assembly is provided at the at least one open end and prevents removal of the tray, clamshell shaped container, or other similarly closed container therethrough. That is, if the outer sleeve has two open ends, then it is an aspect of this invention to provide a locking assembly at each open end.

Yet another aspect of this invention is to provide a package having a locking assembly that releasably engages a ridge defined at a transition region of different sized portions of the tray, clamshell shaped container, or other similarly closed container.

The package includes a first component that is an outer sleeve, which can be tubular in shaped, and includes opposing top and bottom panels, and opposing left and right side panels connecting the top and bottom panels. It should be noted that the geometric shape of the package is in no way limited to tubular as it is within the scope of the invention for the sleeve to be circular, oval, triangular, pentagon, trapezoidal or any other suitable geometric configuration. It should be noted that the inner container, e.g., tray, clamshell shaped container, or other similarly closed container, is also envisioned as having a similar or other configuration that is suitable and lockingly function with the locking assembly of the outer sleeve. Moreover, as noted above, at least one end of the sleeve is open. Further, as note above, the inner container has been referred to as a tray, clamshell shaped container or other similarly closed container. Hereinafter, the inner container will be referred to as a tray for the sake of simplicity, but it should be noted that the terms clamshell shaped container or closed container should be considered interchangeable with the term tray and that the geometric configuration of the inner container, i.e., the tray, is strictly for illustrative purposes and in no way is intended to limit the shape and/or size of the inner container as the inner container may be configured to any suitable shape.

The package also includes a second component that is a tray which is slidable into and out of the sleeve. The tray includes a first portion joined to a second portion, wherein at least one of a height and a width of the first portion is less than a corresponding height and width of the second portion. A difference between one of the height and the width of the first portion and the corresponding height and width of the second portion defines a ridge that is releasably engaged by a locking assembly formed at the open end of the sleeve.

The left side panel, top panel and right side panel of the sleeve each include a locking tab extending into an interior space of the sleeve. A free end of each locking tab opposes the ridge of the tray. The free ends of the corresponding locking tabs define the locking assembly.

BRIEF DESCRIPTION OF THE DRAWINGS

Other objects and features of this invention will be better understood from the following description, with reference to the accompanying drawings, wherein.

DETAILED DESCRIPTION OF THE PREFERRED EMBODIMENTS

Figure 1:
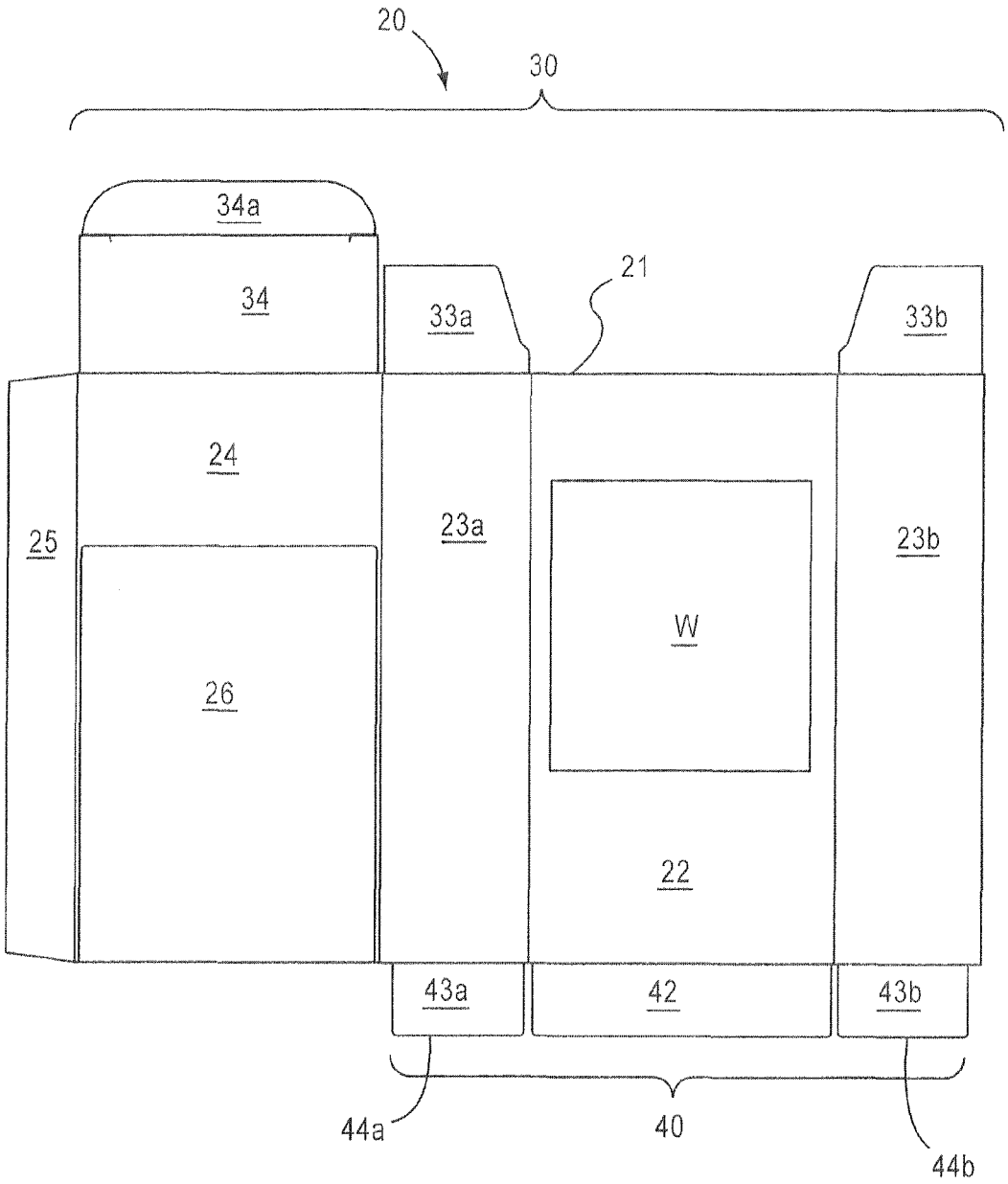
FIG. 1 is a top view of a disassembled outer sleeve of the package according to a preferred embodiment of the invention.

Referring to FIG. 1, the outer sleeve 20 of the package 10 (FIG. 6) is formed from a flat, substantially rectangular shaped single blank 21, ideally made form paperboard. However, it is within the scope of this invention to use any suitable material well known or later developed in the art, such as, for example, paper, plastic, metal, natural or man made, and the like. Furthermore, although not illustrated but well understood in the art, it is within the scope of this invention to use any suitable geometric shape, such as, for example, square, trapezoidal, circular, oval, and the like to form the outer sleeve 20.

Figure 3:
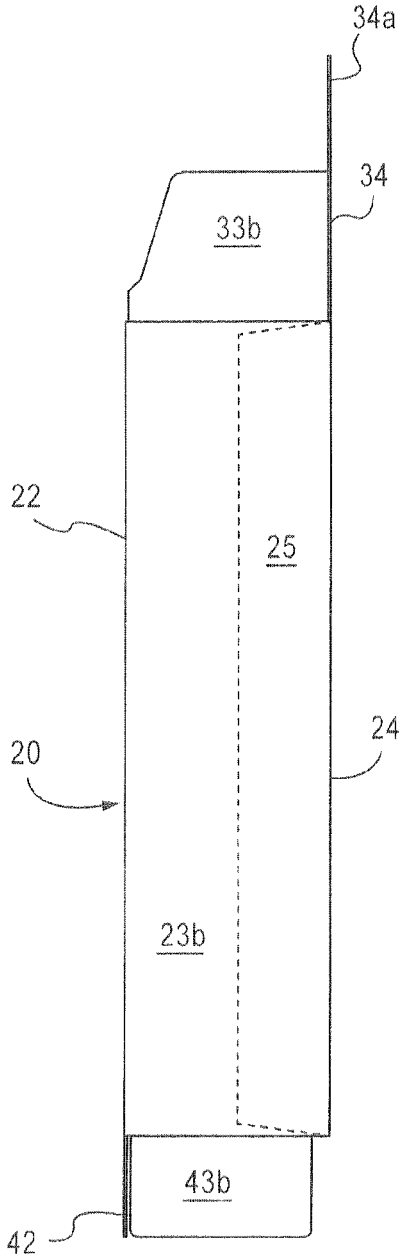
FIG. 3 is a side view of the outer sleeve shown in FIG. 2.

In the exemplary embodiment wherein the sleeve is rectangular, the outer sleeve 20 may include a top or upper panel 22 separated from a bottom or lower panel 24 by a pair of opposing left and right side panels 23*a*, 23*b*. A seal panel 25 extends from a side of the bottom panel 24 that is opposite the side of the bottom panel 24 from which the left side panel 23*a* extends. As shown in FIG. 3, when the outer sleeve 20 is assembled, or at least partially assembled, the seal panel 25 sealingly engages the right side panel 23*b*. In FIG. 3, the seal panel 25 is shown in dashed lines. It should be noted that when the sleeve is of another geometric configuration, such as, for example, a circle, oval, trapezoid, pentagon and the like, the number of side panels may increase or decrease, as is appropriate. As such, the discussion regarding the side panels should not be construed as in any way limiting the number or shape of the side panels. Moreover, although the exemplary embodiment is discussed in relation to four panels, i.e., top, bottom, left and right, it is within the scope of the present invention for the number of panels to increase or decrease, depending on the overall configuration of the sleeve. Also, the shape of the panels may correspondingly change as needed.

Alternatively, the top panel 22 may include an aperture or window W defined therein to permit a visual inspection of the contents of the package 10 therethrough. Moreover, it is within the scope of the invention for a material, either transparent or opaque in nature, to span the window W if necessary for the intended use of the package 10. Furthermore, it is within the scope of the present invention wherein the bottom panel 24 may include a support panel 26 to enhance the strength or provide additional support to the bottom panel 24 to secure an item within the package 10. The optional support panel 26 may also include graphic or other similar indicia thereon providing information with regards to the contents of the package 10.

It should be noted that it is within the scope of the present invention for the seal panel 25 to sealingly engage the right panel 23*b* in any known, suitable manner, such as by an adhesive, ultrasonic welding, epoxy or any other manner that is conventional in the industry. Moreover, the dimensional configuration of the seal panel 25 shown in FIGS. 1 and 3 is merely illustrative. It is within the scope of the invention for the seal panel 25 to be dimensioned according to the desired use of the package 10, and as such, the seal panel 25 may be larger or smaller than that which is illustrated. The seal panel 25 should be sized so as to facilitate assembly of the outer sleeve 20. Alternatively, it is also within the scope of the invention to configure the outer sleeve 20 to omit the seal panel 25, wherein the outer sleeve 20 is formed by joining the right side panel 23*b* to a free side of the bottom panel 24, the free side being the side of the bottom panel 24 from which the seal panel 25 would otherwise extend.

In an alternate embodiment, and one that is illustrated in the drawings, it is within the scope of the present invention for the package to possibly include a closure assembly when both ends of the package are not open ends. For example, an upper or first end of the bottom panel 24 and side panels 23*a* and 23*b* may include tabs that define a closure assembly 30. The closure assembly 30 may includes a left side panel closure tab

Figure 9:
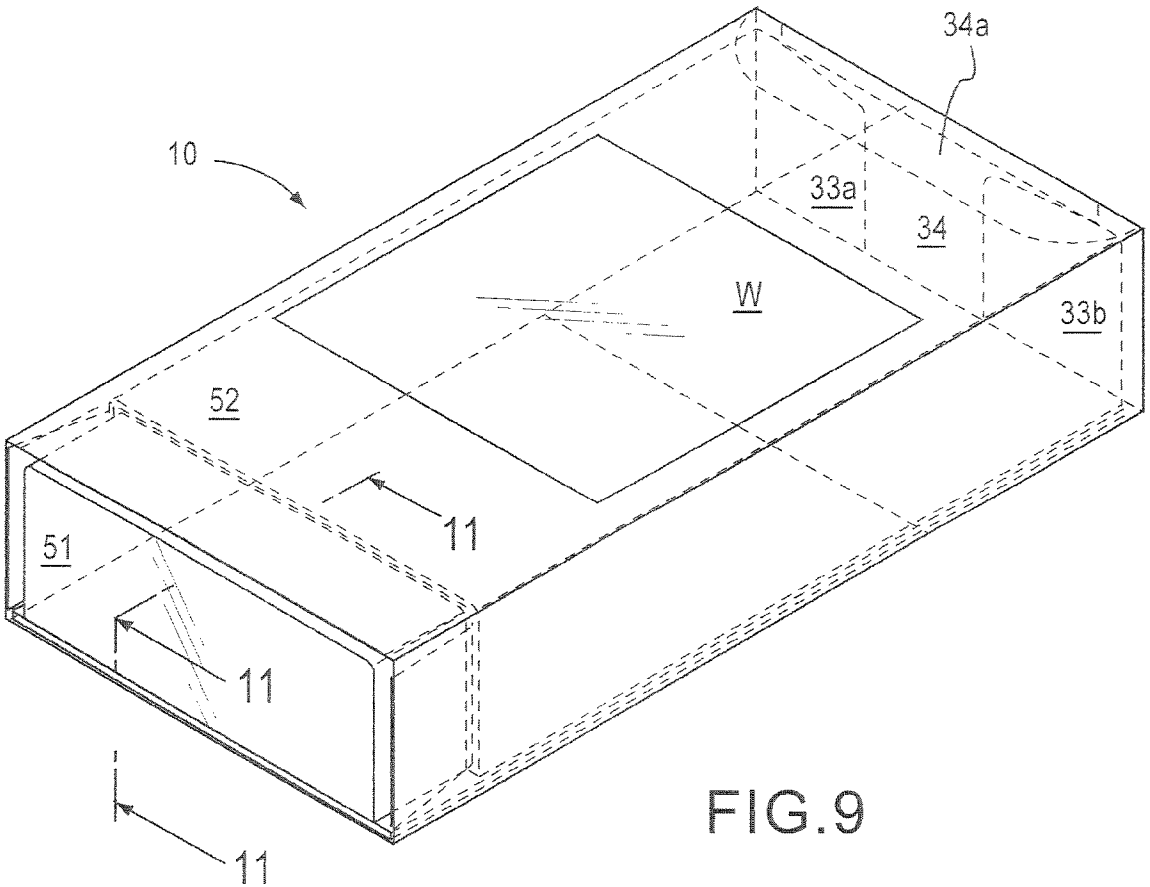
FIG. 9 is a perspective view of the assembled package shown in FIG. 8, wherein an open end of the outer sleeve is sealed closed.
Figure 10:
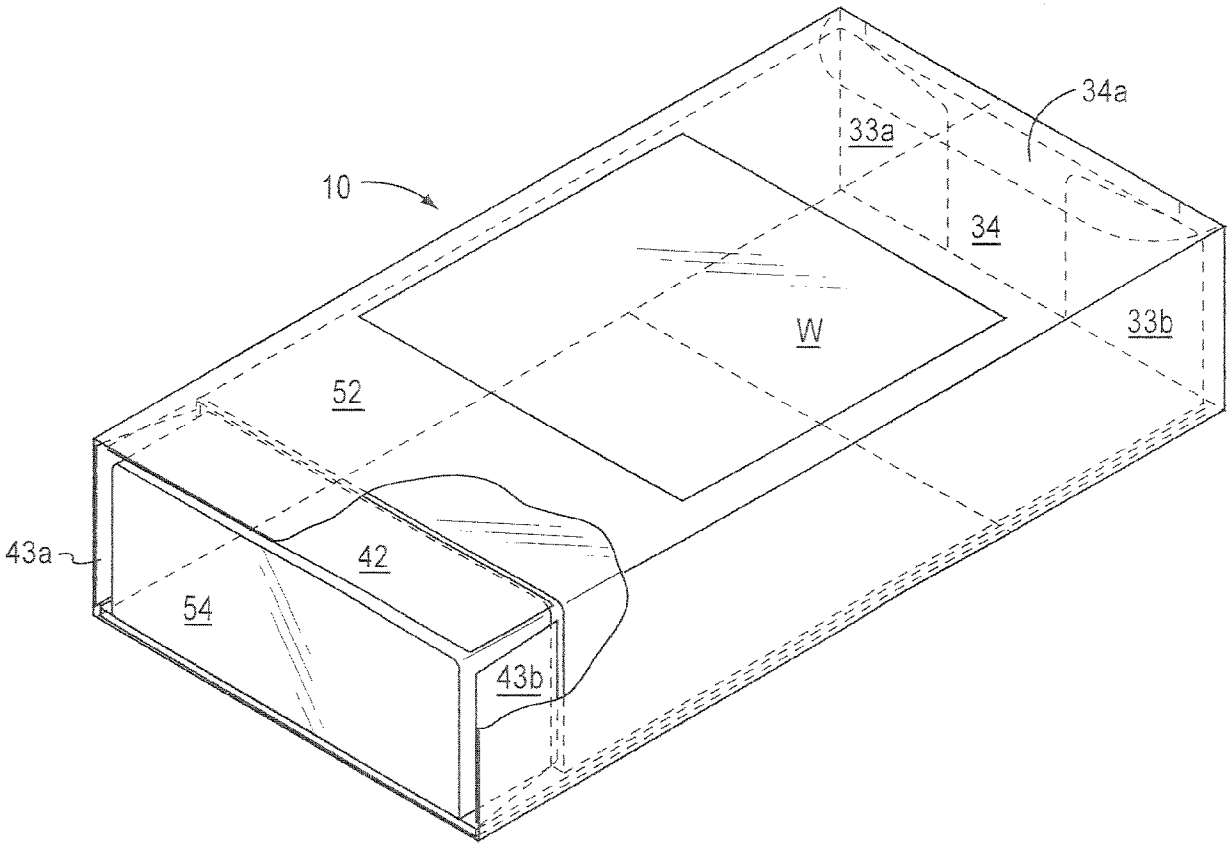
FIG. 10 is a perspective view of the assembled package shown in FIG. 9 with a portion broken away showing tabs of the outer sleeve lockingly engaging upper and side ridges of the tray according to the preferred embodiment of the invention.

33*a* extending from a first end of the left side panel 23*a,* a right side panel closure tab 33*b* extending from a first end of the right side panel 23*b,* and a bottom panel closure tab 34 extending from a first end of the bottom panel 24, wherein a tongue 34*a* may extend from a free end of the bottom panel closure tab 34. As shown in FIGS. 9 and 10, when the outer sleeve 20 is fully assembled, the left and right closure tabs 33*a* and 33*b* may be folded towards each other, and the bottom closure tab 34 folded over an outer surface of the left and right closure tabs 33*a* and 33*b*. The tongue 34*a* could then be inserted into a gap defined between the top panel 22 and the closure tabs 33*a*, 33*b* and 34. The aforementioned closure assembly 30 is merely illustrative for alternative embodiments of the package wherein both ends of the package are not open ends and one of the ends can possibly be a closed end.

Figure 2:
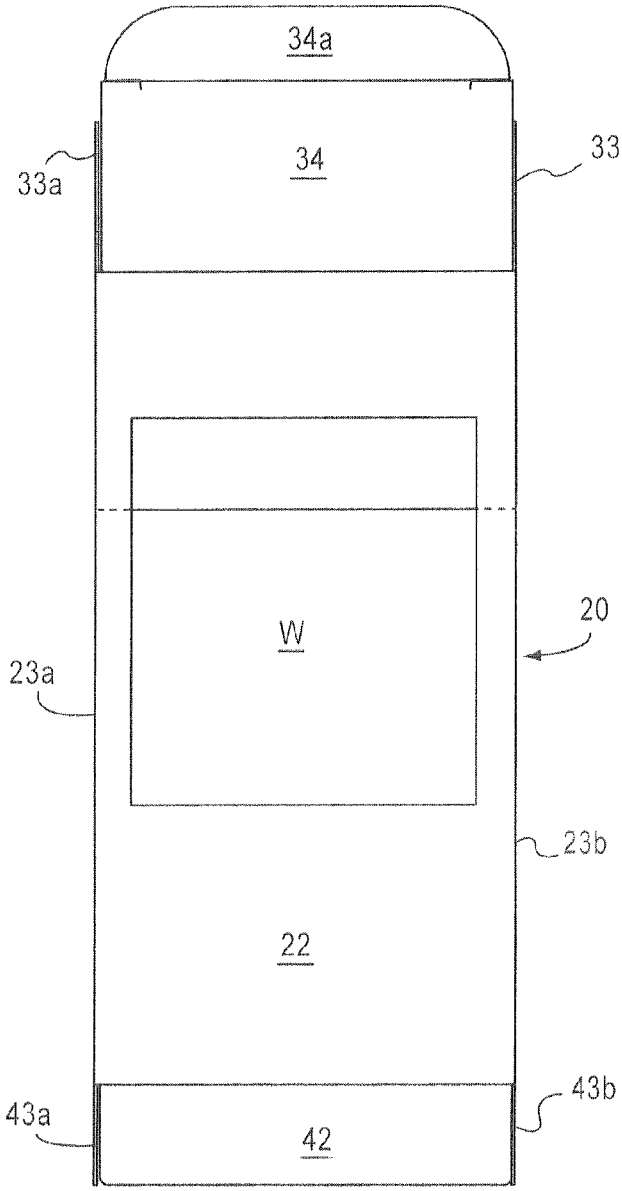
FIG. 2 is a top view of the outer sleeve of the package shown in FIG. 1 in a an assembled state.

Looking at FIGS. 1 through 3, lower or second ends of the side panels 23*a* and 23*b,* as well as the top panel 22, form an exemplary embodiment of a locking assembly 40. The locking assembly 40 includes a left side panel locking tab 43*a* extending from a second end of the left side panel 23*a,* a right side panel closure tab 33*b* extending from a second end of the right side panel 23*b,* and a top panel locking tab 42 extending from a second end of the top panel 22. As shown in FIGS. 6 through 12, when the outer sleeve 20 is fully assembled, the left and right locking tabs 43*a* and 43*b,* as well as the top locking tab 42, are folded into an interior space of the outer sleeve 20, wherein free ends 44*a* and 44*b* of the left and right locking tabs 43*a* and 43*b,* respectively, and a free end 42*a* of the top locking tab 42*a,* are separated from an inner surface of the left and right side panels 23*a* and 23*b,* respectively, and the top panel 22 by a predetermined distance.

Figure 11:
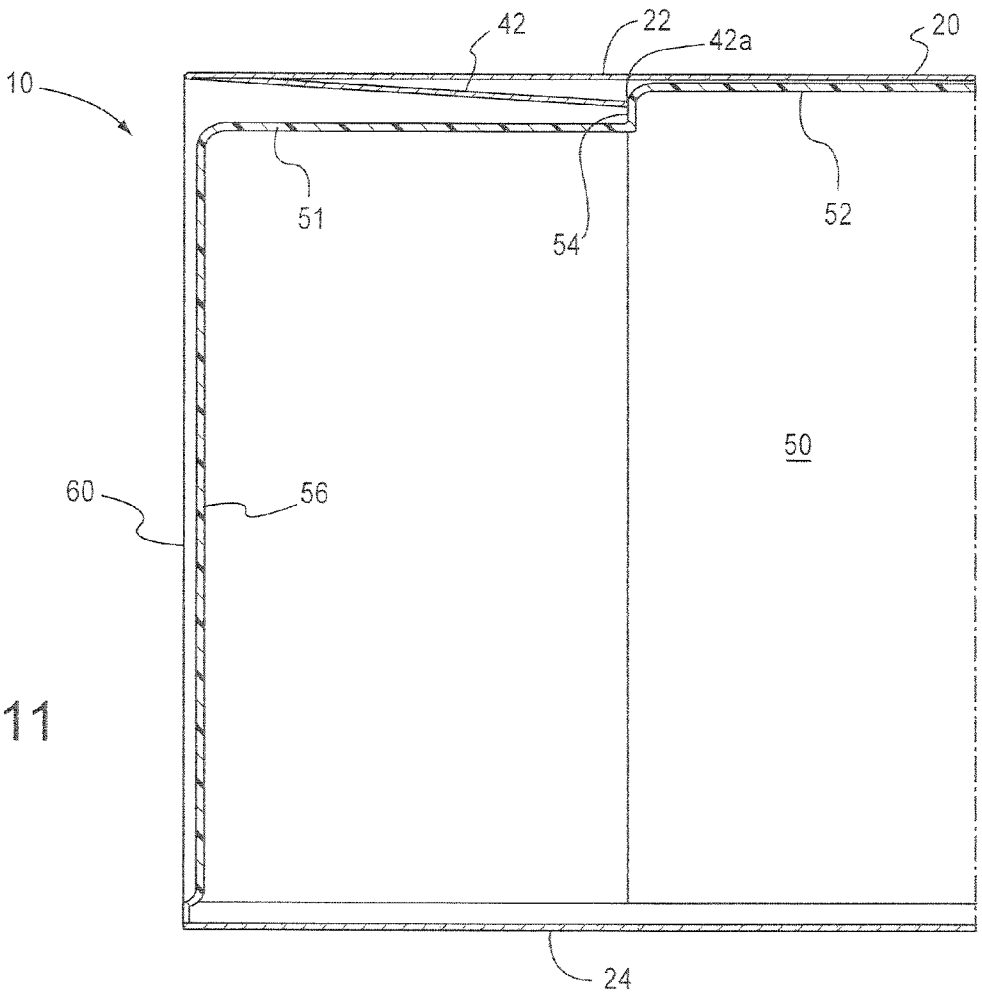
FIG. 11 is a cross-sectional side view of an upper tab of the outer sleeve engaging an upper ridge of the tray taken along line 11-11 of FIG. 9.
Figure 12:
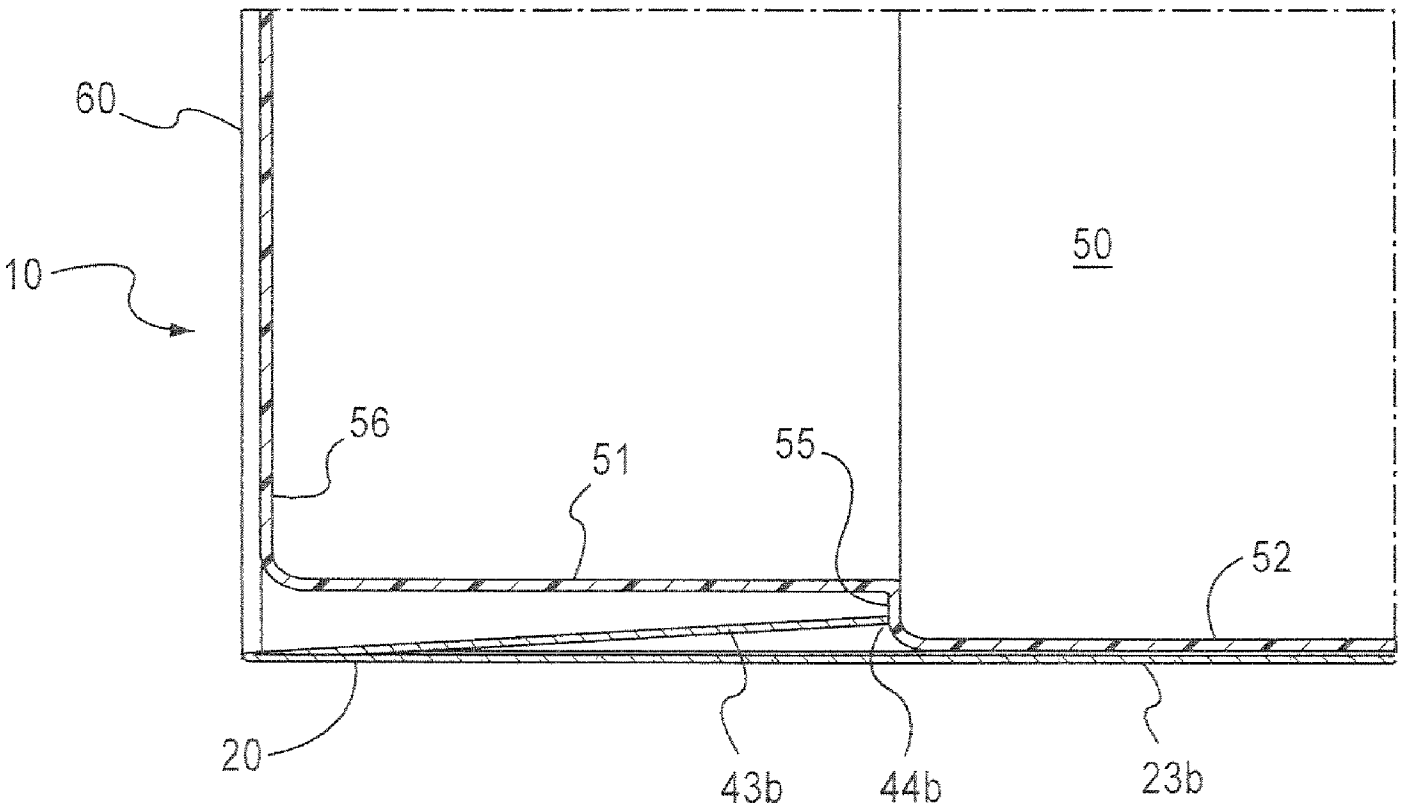
FIG. 12 is a partial cross-sectional top view of a side tab of the outer sleeve engaging a side ridge of the tray taken along line 12-12 of FIG. 8.

FIG. 11 provides an exemplary illustration of the free end 42*a* of the top locking tab 42 separated from the inner surface of the top panel 22. FIG. 12 provides an exemplary illustration of the free end 44*b* of the right locking tab 43*b* separated from the inner surface of the right side panel 23*b*. A similar arrangement is provided for the free end 44*a* of the left locking tab 43*a,* which is not shown.

To assemble the outer sleeve, the bottom panel 24 can be folded over a first edge of the left side panel 23*a*, and the bottom panel 24 and left side panel 23*a* can be folded over a first edge of the top panel 22. The right side panel 23*b* may then be folded over a second edge of the top panel 22, the second edge opposing the first edge. If provided, the seal panel 25 may be folded onto and joined to the right side panel 23*b* in any conventionally known manner. Alternatively, the free edge of the bottom panel 24, which is defined or formed when the seal panel 25 is not provided, is then joined or attached to a free edge of the rights side panel 23*b* to form a tubular, partially assembled outer sleeve 20. See FIGS. 2 and 3.

Figure 4:
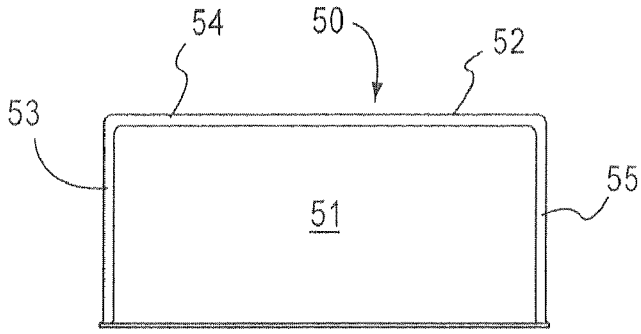
FIG. 4 is a lower end view of a tray insertable into the outer sleeve according to a preferred embodiment of the invention.
Figure 5:
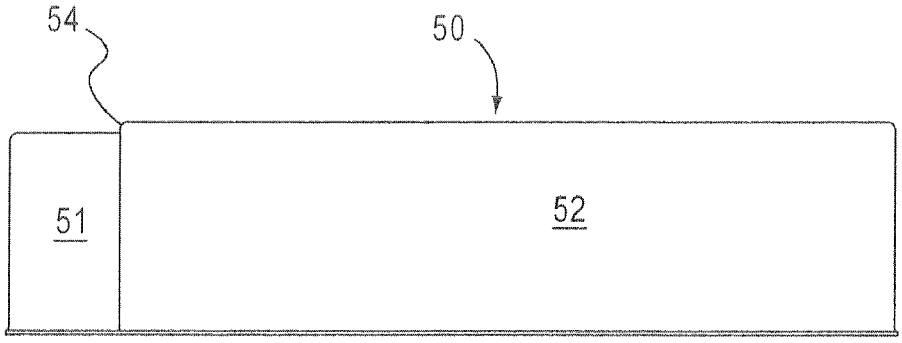
FIG. 5 is a right side view of the tray shown in FIG. 4.

As shown in FIGS. 4 and 5, the exemplary inner container or tray 50 may include a first portion 51 integral to and extending from a second portion 52, wherein the first portion 51 has a height and a width that is less than a height and width of the second portion 52. The differences in height and width between the first and second portions 51 and 52 define a left side ridge 53, an upper ridge 54 and a right side ridge 55. As shown in FIG. 4, the left side ridge 53, upper ridge 54 and rights side ridge 55 are surfaces of the tray 50 which connect the first and second portions 51 and 52 to each other.

The tray 50 may be formed from a transparent material, as shown in FIGS. 6 through 10. However, it is within the scope of the invention for the tray 50 to be formed from any other suitable material. The manner in which the tray 50 is formed may be chosen from any conventional manner and should be based on the intended use of the package 10, so long as the manufacturing technique chosen is able to form the tray 50 to have at least one of the ridges 53 through 55.

Figure 6:
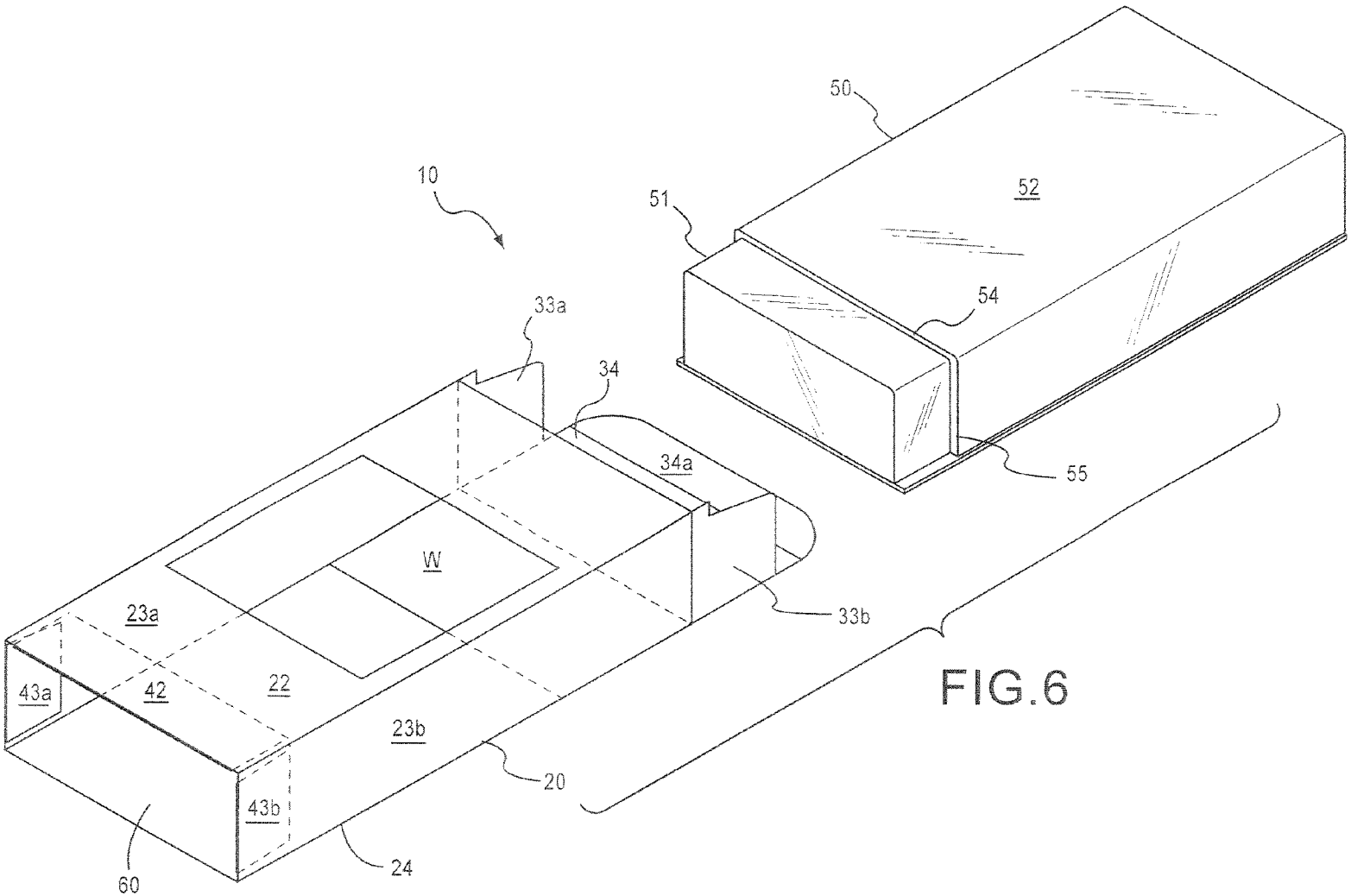
FIG. 6 is a perspective view of the tray outside of the assembled outer sleeve.
Figure 7:
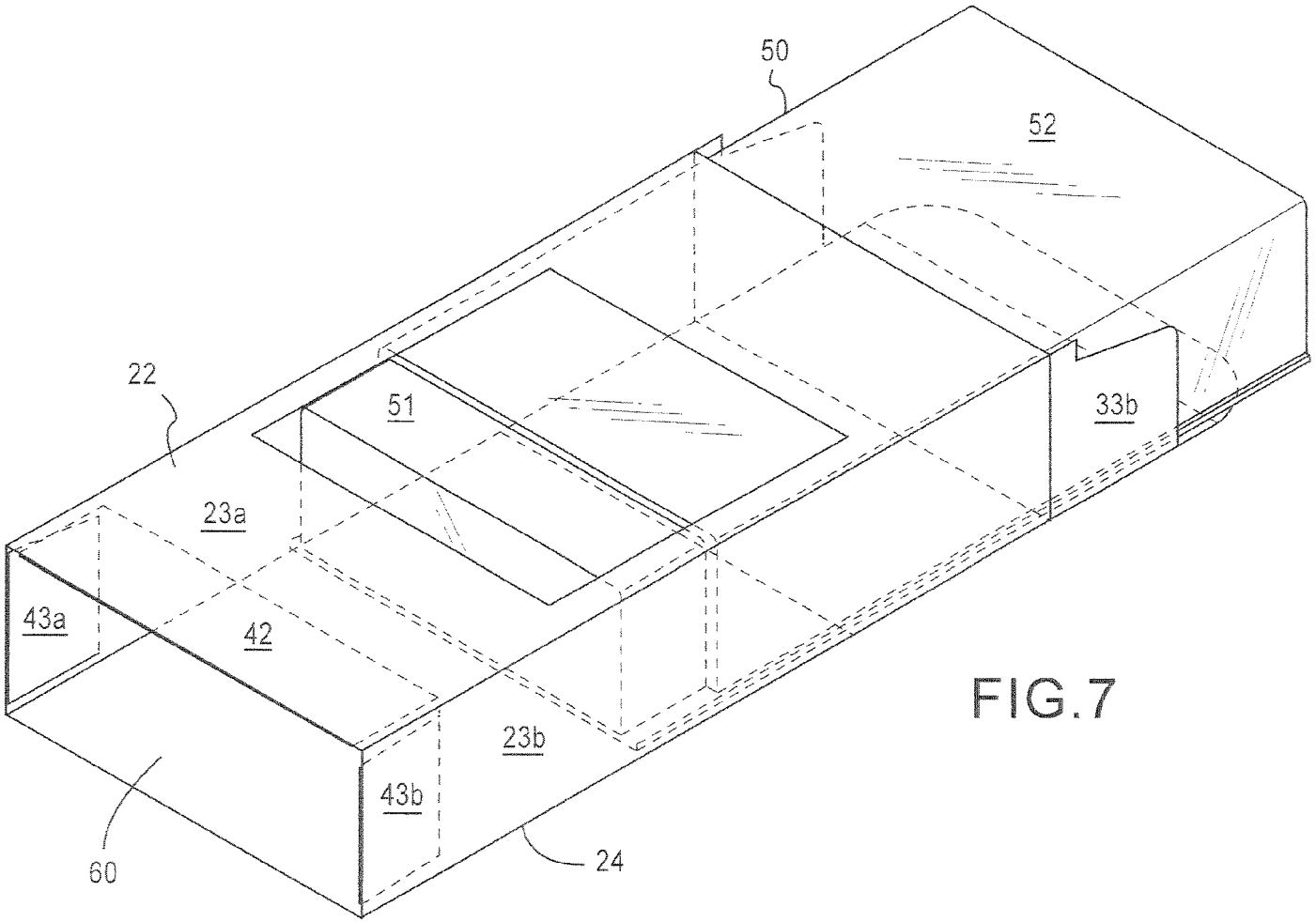
FIG. 7 is a perspective view of the tray partially inserted into the outer sleeve.

Looking at FIG. 6, to assemble the package 10, the locking tabs 42, 43*a* and 43*b* of the locking assembly 40 are folded inward and into the interior space of the tubular outer sleeve 20. The closure tabs 33*a*, 33*b*, and 34 of the closure assembly 30 are maintained in an open state so as to receive the tray 50. The tray 50 is slid into the sleeve 20 by first sliding the first portion 51 of the tray 50 into an opening defined by the closure tabs 33*a*, 33*b* and 34*a* maintained in an open state, as shown in FIG. 7.

Figure 8:
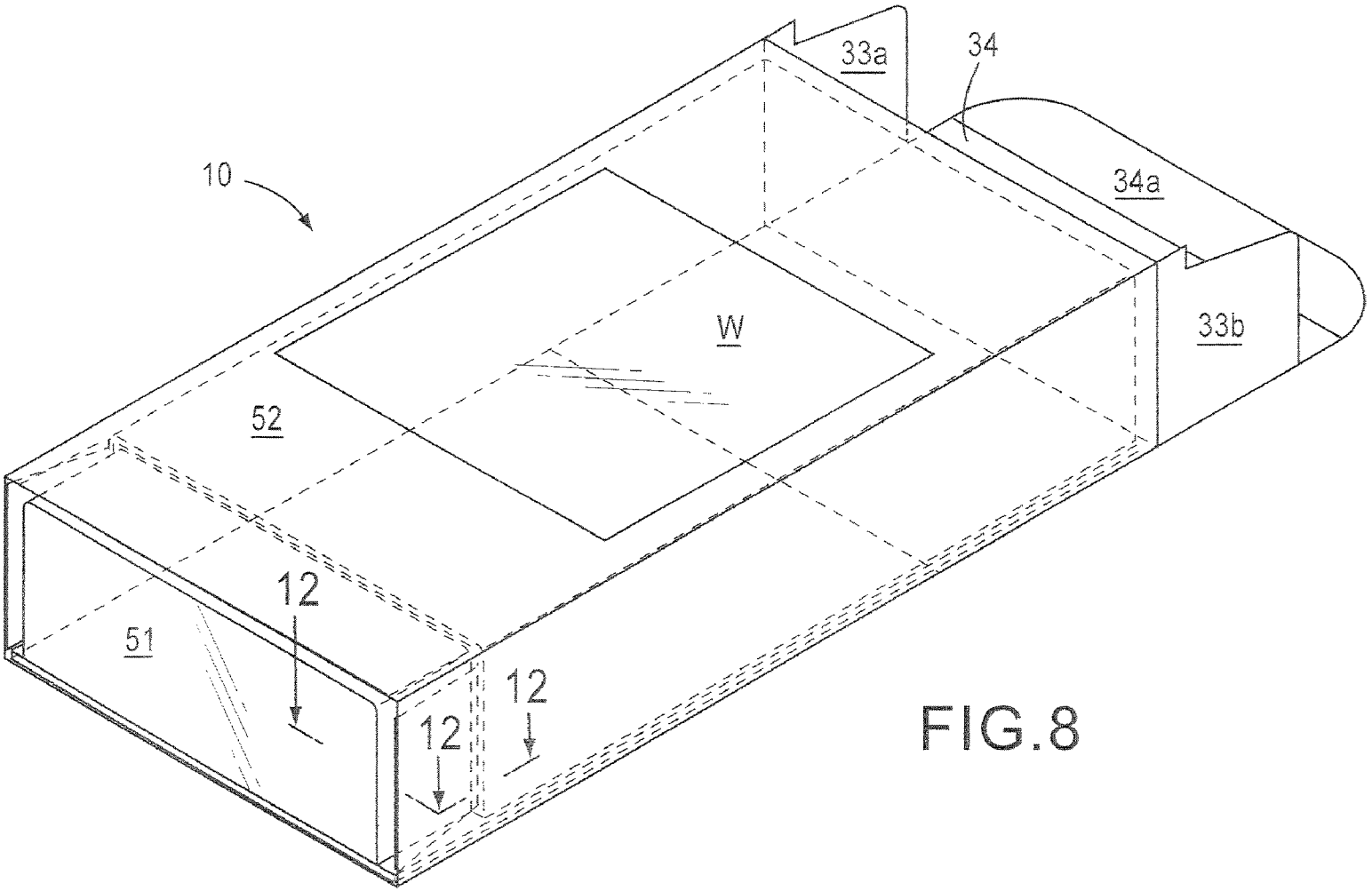
FIG. 8 is a perspective view of the assembled package according to the preferred embodiment of the invention wherein the tray is completely inserted into the outer sleeve.

As shown in FIG. 8, the tray 50 is further slid into the outer sleeve 20 and is completely placed within the sleeve 20 such that the first portion 51 is visible through an open end of the package 20. Turning to FIG. 9, the left and right side closure tabs 33*a* and 33*b* are folded inward so as to be substantially parallel with a rear face of the second portion 52 of the tray 50. The bottom closure tab 34 is then folded over and onto an outer surface of the left and right side closure tabs 33*a* and 33*b*. The tongue 34*a* is then inserted into the gap defined between the top panel 22 and free edge of the left and rights side closure tabs 33*a* and 33*b* to seal the tray 50 within the outer sleeve 20.

It should be noted that it within the scope of the invention for the bottom closure tab 34 to be adhered or otherwise affixed to the left and right side closure tabs 33*a* and 33*b* in any suitable manner that is conventional in the industry, such as by an adhesive, tape, epoxy, ultrasonic welding, and the like. Alternatively, the closure assembly may maintain the subject end of the outer sleeve in a closed state simply be securely retaining the tongue 34*a* in the gap defined between the top panel 22 and left and right side closure tabs 33*a* and 33*b*.

FIGS. 10 through 12 will now be referenced to explain how the locking assembly 40 prevents the tray 50 from easily being removed from the open end of the outer sleeve 20. In particular, the cutaway portion of the outer sleeve 20 illustrated in FIG. 10 shows the free ends 42*a*, 44*a* and 44*b* of the top locking tab 42, left side locking tab 43*a* and right side locking tab 43*b* of the outer sleeve 20 engaging or otherwise abutting the left side ridge 53, upper ridge 54 and right side ridge 55, respectively, of the tray 50 to lock the tray 50 within the outer sleeve 20 or otherwise prevent the tray 50 from easily being removed therefrom.

More specifically, looking at FIG. 11, which shows a cross-sectional side view of the tray 50 being securely maintained within the outer sleeve 20 of the package 10, the top panel locking tab 42 is shown being folded inward into the interior space of the outer sleeve 20 and slightly angled toward an upper surface of the first portion 51 of the tray 50. The free end 42*a* of the top panel locking tab 42 is maintained a predetermined distance from an inner surface of the top panel 22. At the same time, the free end 42 of the top panel locking tab 42 may either be directly engaging the upper ridge 54 of the tray 50 or separated therefrom a distance that allows for a slight or nominal movement of the tray 50, but otherwise prevents the tray 50 from being removed from an open end 60 of the outer sleeve 20.

Similarly, looking at FIG. 12, which shows a partial cross-sectional top view of the tray 50 being securely maintained within the outer sleeve 20 of the package 10, the right side panel locking tab 43*b* is shown being folded inward into the interior space of the outer sleeve 20 and slightly angled toward a right side surface of the first portion 51 of the tray 50, The free end 44*b* of the right side panel locking tab 43*b* is maintained a predetermined distance from an inner surface of the right side panel 23*b*. At the same time, the free end 44*b* of the right side panel locking tab 43*b* may either be directly engaging the right side ridge 55 of the tray 50 or separated therefrom a distance that allows for a slight or nominal movement of the tray 50, but otherwise prevents the tray 50 from being removed from an open end 60 of the outer sleeve 20. it should be noted that the free end 44*a* of the left side panel locking tab 43*a* may be configured and operate in an identical manner to that of the above-described free end 44*b* of the right side panel locking tab 43*b*. As such, a description and illustration thereof is omitted herefrom to avoid redundancy.

Accordingly, the free end 44*a* of the left side panel locking tab 43*a* engaging the left side ridge 53 of the tray 50 or distanced therefrom a nominal distance to prevent removal of the tray 50 through the open end 60 of the outer sleeve 20; and/or the free end 42*a* of the top panel locking tab 42 engaging the upper ridge 54 of the tray 50 or distanced therefrom a nominal distance to prevent removal of the tray 50 through the open end 60 of the outer sleeve; and/or the free end 44*b* of the right side panel locking tab 43*b* engaging the right side ridge 54 of the tray 50 or distanced therefrom a nominal distance to prevent removal of the tray 50 through the open end 60 of the outer sleeve 20 effectively locks the tray 50 within the outer sleeve 20 of the package 10.

To remove the tray 50 from the sleeve 20, an individual can open or disengage the closure tabs 33*a*, 33*b* and 34 of the closure assembly 30 defined at the closed end of the package 10 in a conventional manner. Alternatively, if the individual desires to remove the tray 50 from the open end 60, the individual can insert a thin object into the open end 60 of the outer sleeve 20 and disengage the free ends 42*a* and/or 44*a* and/or 44*b* of the locking tabs 42, 43*a* and 43*b*, respectively, from the upper ridge and/or left side ridge 53 and/or right side ridge 54, respectively. As such, the free ends 42*a*, 44*a*, and 44*b* do not engage the relevant ridges 53, 54 and 55 of the tray 50 such that the tray 50 can be slid through the open end 60 of the outer sleeve 20.

The above described structural configuration of the package 10 provides a package that is easy to use yet prevents unwanted access to the product(s) contained therein.

Many modifications may be made to adapt the teachings of the package of this invention to particular situations or materials without departing form the scope thereof. Therefore, the invention should not be limited to the particular embodiments disclosed herein, but includes all embodiments within the spirit and scope of the disclosure.

We claim:

1. A lockable package comprising:

an outer sleeve defined by connected first and second panels, the sleeve having at least one open end;

an inner container slidable within the outer sleeve, the inner container having a first portion and a second portion, the first portion and the second portion each having an open end opposing a closed end, wherein the closed ends of the first and second portions oppose each other, the open ends of the first and second portions being located between the closed ends of the first and second portions, and the open end of the first portion is joined to the open end of the second portion, at least one of a height and a width of the first portion being less than a corresponding height and width of the second portion, a difference between one of the height and the width of the first portion and the corresponding height and width of the second portion defining a ridge located between the first and second portions; and a locking assembly provided at the at least one open end of the outer sleeve and configured to releasably engage the ridge, wherein the locking assembly includes at least one locking tab extending in an inward direction from the at least one open end toward an interior space of the outer sleeve defined by the first and second panel, wherein the inner container is removable through the at least one open end of the sleeve by disengaging the locking assembly from the ridge.

2. The package according to claim 1, wherein the at least one locking tab includes a free end separated from an interior surface of the first panel.

3. The package according to claim 2, wherein the free ends lockingly engages the ridge.

4. The package according to claim 1, wherein the outer sleeve is configured to have a geometric shaped selected from one of: a rectangle, a square, an oval, a circle, a triangle, a pentagon, and a trapezoid.

5. The package according to claim 1, wherein the inner container is configured to be one of an open faced tray, a clamshell shaped container, and a closed container.

6. The package according to claim 1, wherein the at least one open end includes a first open end opposite a second open end.

7. The package according to claim 1, wherein the ridge comprises a first ridge, a second ridge, and a third ridge connected to the first ridge by the second ridge.

8. The package according to claim 7, wherein the first ridge opposes the third ridge, the first ridge and the third ridge being orthogonal relative to the second ridge.

9. The package according to claim 7, wherein the second ridge is defined by the difference between the height of the first portion and the corresponding height of the second portion.

10. The package according to claim 7, wherein the first ridge and the third ridge are defined by the difference between the width of the first portion and the corresponding width of the second portion.

11. The package according to claim 1, wherein the first panel is a top panel and the second panel is a bottom panel, the outer sleeve further including a left side panel and a right side panel opposite the left side panel, the left and right side panels connecting the top and bottom panels.

12. The package according to claim 11, wherein the locking assembly is provided at a free end of at least one of the left side panel, the top panel and the right side panel.

13. The package according to claim 12, wherein the locking tab includes a free end separated from an interior surface of the outer sleeve.

14. The package according to claim 13, wherein the free end of the locking tab opposes and releasably engages the ridge.

* * * * *